US005768922A

United States Patent [19]

Lax

[11] Patent Number: 5,768,922

[45] **Date of Patent: *Jun. 23, 1998**

[54] SECURITY CASE WITH FIELD ACTIVATED LOCKING MECHANISM

[75] Inventor: Michael R. Lax, Oyster Bay Cove, N.Y.

[73] Assignee: Autronic Plastics, Inc., Westbury, N.Y.

[ * ] Notice: The term of this patent shall not extend beyond the expiration date of Pat. No. 5,598,728.

[21] Appl. No.: 656,039

[22] Filed: May 24, 1996

Related U.S. Application Data

[63] Continuation-in-part of Ser. No. 398,280, Mar. 3, 1995, Pat. No. 5,598,728.

[51] Int. Cl.[6] ..... E05B 47/00

[52] U.S. Cl. ..... 70/276; 70/58; 70/63; 70/57.1; 206/387.1

[58] Field of Search ..... 70/413, 276, 57, 70/57.1, 58, 63; 206/387.11–387.15, 387.1

[56] References Cited

U.S. PATENT DOCUMENTS

| | | | |
|---|---|---|---|
| 517,729 | 4/1894 | Cable . | |
| 1,707,225 | 4/1929 | Jackson . | |
| 2,393,034 | 1/1946 | Ellis et al. | 220/210 |
| 2,730,392 | 1/1956 | Thiebaud . | |
| 2,916,901 | 12/1959 | Claud-Mantle | 220/315 |
| 3,495,716 | 2/1970 | Gregory . | |
| 3,497,908 | 3/1970 | Zamarra | 220/338 |
| 3,837,525 | 9/1974 | Kobayashi . | |
| 3,855,827 | 12/1974 | Hallman et al. . | |
| 3,933,240 | 1/1976 | Humble | 206/1.5 |
| 3,994,416 | 11/1976 | Mulligan | 220/338 |
| 4,109,821 | 8/1978 | Lutz | 220/338 |
| 4,453,743 | 6/1984 | Sanders et al. . | |
| 4,469,225 | 9/1984 | Takahashi . | |
| 4,722,439 | 2/1988 | Grobecker et al. . | |
| 4,819,797 | 4/1989 | Holmgren . | |
| 4,966,020 | 10/1990 | Fotheringham et al. . | |
| 4,972,690 | 11/1990 | O'Sullivan . | |
| 5,007,256 | 4/1991 | Lowe . | |
| 5,076,460 | 12/1991 | Hussell | 220/337 |
| 5,103,978 | 4/1992 | Secor . | |
| 5,193,371 | 3/1993 | Yamane . | |
| 5,209,086 | 5/1993 | Bruhwiler . | |
| 5,368,162 | 11/1994 | Holmgren . | |
| 5,375,712 | 12/1994 | Weisburn . | |

*Primary Examiner*—Steven N. Meyers
*Assistant Examiner*—Tuyet-Phuong Pham
*Attorney, Agent, or Firm*—Ostrolenk, Faber, Gerb & Soffen, LLP

[57] ABSTRACT

A security device includes a case having a bottom open end to receive merchandise, a top surface, two opposing ends and two opposing sidewall surfaces; at least one tab protruding from the case; and a locking mechanism for maintaining the received merchandise in the case. The locking mechanism includes a base housing including at least one slot to receive and retain the tab to help secure the case to the locking mechanism, at least one flange extending from the base housing to overlie at least one surface of the case, and a movable member. The moveable member (i) maintains the received merchandise in the case by blocking the front of the bottom open end and securing the tab in the slot when the locking mechanism is closed and (ii) disengages from the front of the bottom open end when the locking mechanism is open allowing the tab to become fully separated from the slot and the locking mechanism to become fully separated from the case. A decoupler is provided for opening the locking mechanism.

59 Claims, 10 Drawing Sheets

Fig. 1
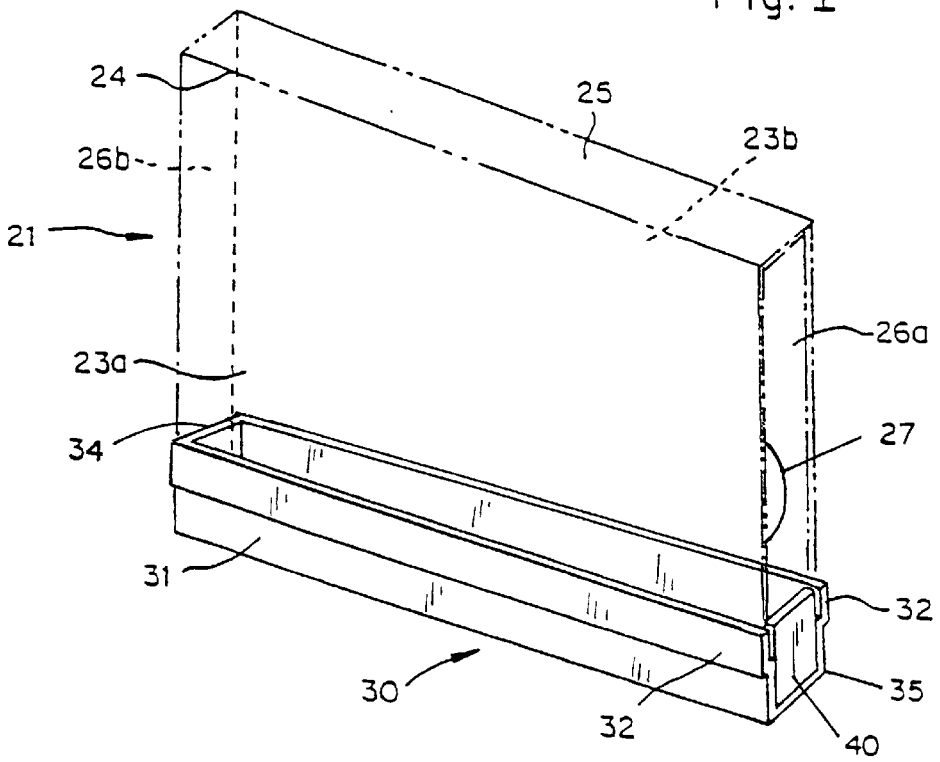
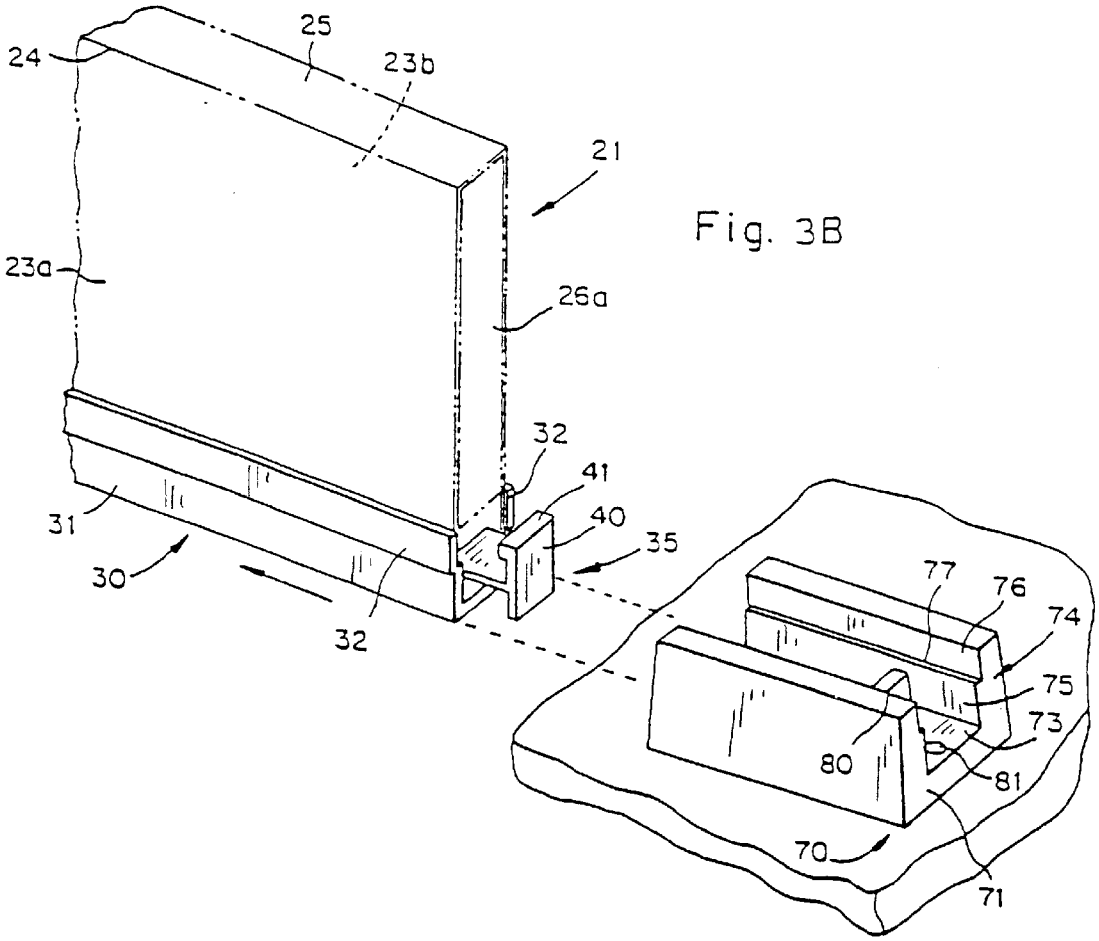
Fig. 3B

SECURITY CASE WITH FIELD ACTIVATED LOCKING MECHANISM

CROSS-REFERENCE TO RELATED APPLICATIONS

This is a continuation-in-part application of U.S. patent application Ser. No. 08/398,280 filed Mar. 3, 1995, now U.S. Pat. No. 5,598,728 the entire disclosure of which is incorporated by reference herein.

BACKGROUND OF THE INVENTION

1. Field of the Invention

The invention relates generally to protecting merchandise in a retail setting. More particularly, the invention relates to a bottom loading security case for videotapes or video cassettes which are marketed on live display.

2. Description of the Art

When video rental stores first began operating, the merchandising format used was a "fetch system". In a fetch system, empty display boxes are exhibited on shelves and a customer selects a title by physically bringing the empty display box to a clerk at the check out counter. The clerk then "fetches" the video tape or cassette of the selected title from a secure location where the actual cassettes are kept and delivers it to the customer. While this format has high security, it is not appealing as it increases labor and time to provide a customer with the cassette of the selected title and requires expanded inventory space to store separately the cassettes and empty display boxes.

To solve these problems, the merchandising format for video rental stores has changed to leave all the videotapes or video cassettes out in the store "live"; i.e. the cassettes are left in the displayed boxes. In such a "live" video rental store, a customer selects a title and brings the display box, with the cassette inside, to the check out counter. Thus, the live merchandising format decreases cost by saving on labor and time, and reducing the amount of inventory space.

To provide security against pilferage in a live merchandising format, video rental stores usually place a security strip on the cassette, or on or in the display box. However, if the security strip is placed on the cassette, it must be positioned so as not to interfere with the operation of a video cassette recorder. When the security strip is in place, an alarm will sound if there is an attempt to conceal the item when leaving the store with a customer. This has been found to be quite successful in preventing pilferage so long as the security strip is in place. However, the security can be by-passed by removing the cassette from the display box when the security strip is in or on the box, or "peeling" the security strip from the cassette.

Recently, rental of video games has become a substantial part of the business of video rental stores. These video games are packaged as a cartridge having a particular shape depending upon the brand of video game machine for which it is designed. It has been found that when a live merchandising format and security strip are used for video game cartridges, substantial pilferage occurs.

This is believed to result from the fact that a video game cartridge is substantially smaller than a video cassette and, therefore, more easily concealed. When the security strip is placed somewhere on or in the display box, it is quite easy to steal the video game by removing the cartridge from the display box and then concealing it while leaving the store. The same is true when the security strip is placed on the video game cartridge since the security strip can be peeled away. As a result, most video rental stores keep video game cartridges in a secure place, separate from the display boxes. This means that the stores have returned to the old "fetch system" which requires increased inventory space, labor and time. In addition, the "fetch system" is contradictory to the live merchandising format for which the video rental store is usually set up.

Accordingly, there is a need to provide protection for video cassettes and video game cartridges without increasing inventory space, labor and time.

SUMMARY OF THE INVENTION

It is feature and advantage of the invention to provide a novel mechanism for protecting displayed merchandise from theft.

It is another feature and advantage of the invention to provide a novel mechanism for protecting videotapes and the like, and particularly videotapes housed in bottom loaded cases, consistent with a live merchandising format, requiring no increase in inventory space, and being simple and convenient to use.

It is another feature and advantage of the invention to provide a novel mechanism for protecting videotapes and the like that is compatible with the use of a security strip.

It is another feature and advantage of the invention to make a security strip inaccessible to customers when it is used to protect videotapes and the like.

According to the present invention, the foregoing features and advantages are attained by a security device comprising a case having a bottom open end to receive merchandise, a top surface, two opposing ends and two opposing sidewall surfaces. At least one tab protrudes from the case. A locking mechanism maintains the received merchandise in the case.

The locking mechanism includes a base housing having at least one slot to receive and retain the tab to help secure the case to the locking mechanism, and at least one flange extending from the base housing to overlie at least one surface of the case.

A movable member (i) maintains the received merchandise in the case by blocking the front of the bottom open end and securing the tab in the slot when the locking mechanism is closed and (ii) disengages from the front of the bottom open end when the locking mechanism is open allowing the tab to become fully separated from the slot and the locking mechanism to become fully separated from the case.

A steel pin is retained in at least one sleeve attached to an inner surface of the base housing and is biased against a surface of the movable member for retaining the movable member from moving when the locking mechanism is closed.

In a preferred embodiment, the steel pin is biased against a surface of the movable member by a spring between the steel pin and a corresponding inner surface of the base housing.

Preferably, the security device includes a decoupler for releasing the retained movable member when the locking mechanism is closed. In a preferred embodiment, the decoupler comprises a U-shaped housing with a flat upper surface, two inner surfaces extending from the flat upper surface, an outer surface corresponding to each inner surface, and a vertical cross rib attached to the flat upper surface between the two inner surfaces.

A magnet is positioned in the U-shaped housing between at least one inner surface and the corresponding outer surface, the magnet attracting the steel pin when the closed locking mechanism is positioned in the decoupler with the movable member engaging the vertical cross rib.

Other features and advantages of the present invention will become apparent to those skilled in this art from the following detailed description, where only the preferred embodiment of the invention is shown and described, simply by way of illustration of the best mode contemplated of carrying out the invention. As will be realized, the invention is capable of other and different embodiments in various obvious respects, all without departing from the invention. Accordingly, the drawings and description are to be regarded as illustrative in nature, and not as restrictive.

BRIEF DESCRIPTION OF THE DRAWINGS

FIG. 1 is a perspective view of a security case of the present invention with the case latched.

FIG. 3B is a perspective view of the security case after the locking mechanism has been unlocked by the decoupler, with the decoupler disengaged.

DETAILED DESCRIPTION OF THE INVENTION

Referring to FIGS. 1–4, a security case of the present invention includes a case 21 for holding merchandise such as a videotape or cassette and a lock 30 for latching the case closed. Preferably, the case 21 is of the type shown and described in U.S. Pat. No. 5,085,322, dated Feb. 4, 1992, the entire disclosure of which is incorporated by reference herein. While the preferred embodiment assumes that videotapes or even game cartridges will be retained in the case 21, it should be readily apparent to those skilled in the art that other types of merchandise can be retained, and the present invention is not limited by the particular type of merchandise which is held in the case.

The case 21 is generally in the shape of a rectangular box, with a top 23*a,* bottom 23*b,* spine 25, open end 26*a,* and sidewalls 26*b,* 26*c*. In a preferred embodiment, the open end 26*a* permits the entry and removal of a videotape. In a preferred embodiment, the sidewall 26*b* may include a door pivotally attached to the case 21 by a hinge, as shown and described in U.S. Pat. No. 5,085,322. The purpose of a door would be to permit insertion of a graphics sleeve, as shown and described in U.S. Pat. No. 5,085,322.

Figure 2:
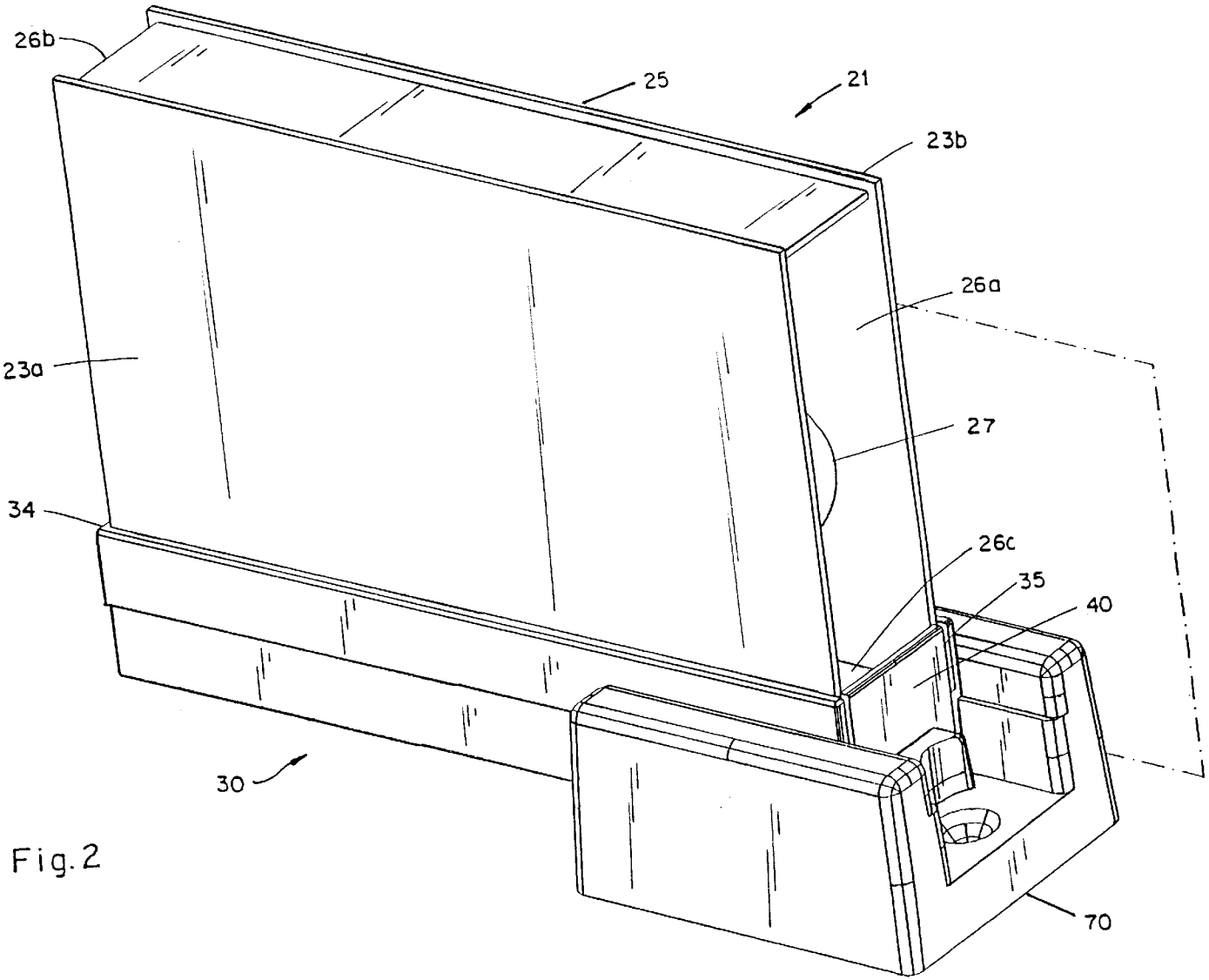
FIG. 2 is a perspective view of the security case with a locking mechanism engaging the locking mechanism decoupler.
Figure 3A:
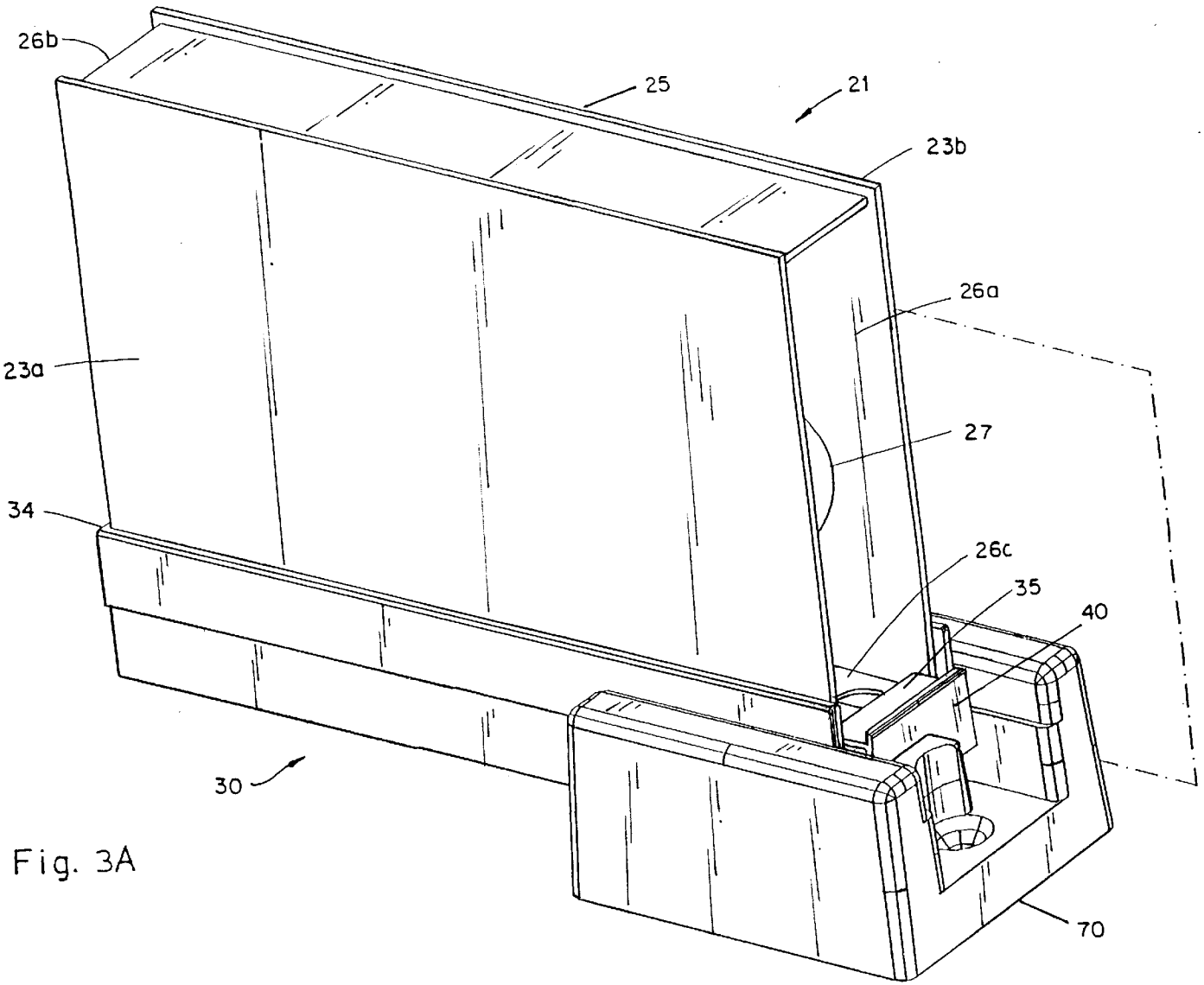
FIG. 3A is a perspective view of the security case after the locking mechanism has been unlocked by the decoupler, with the decoupler engaged.
Figure 4A:
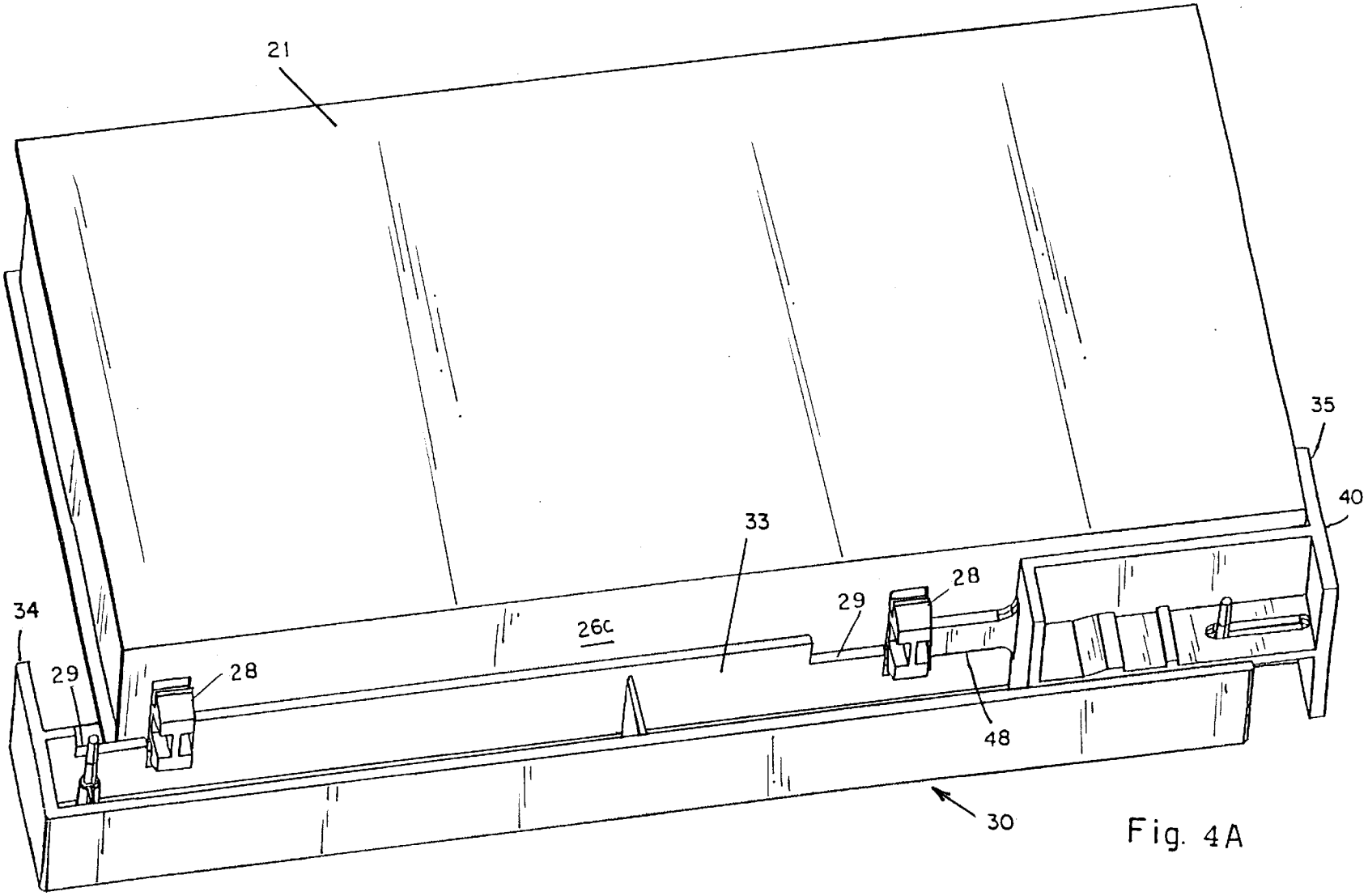
FIG. 4A is a partially broken away view of the locking mechanism after initial insertion on the case.
Figure 4B:
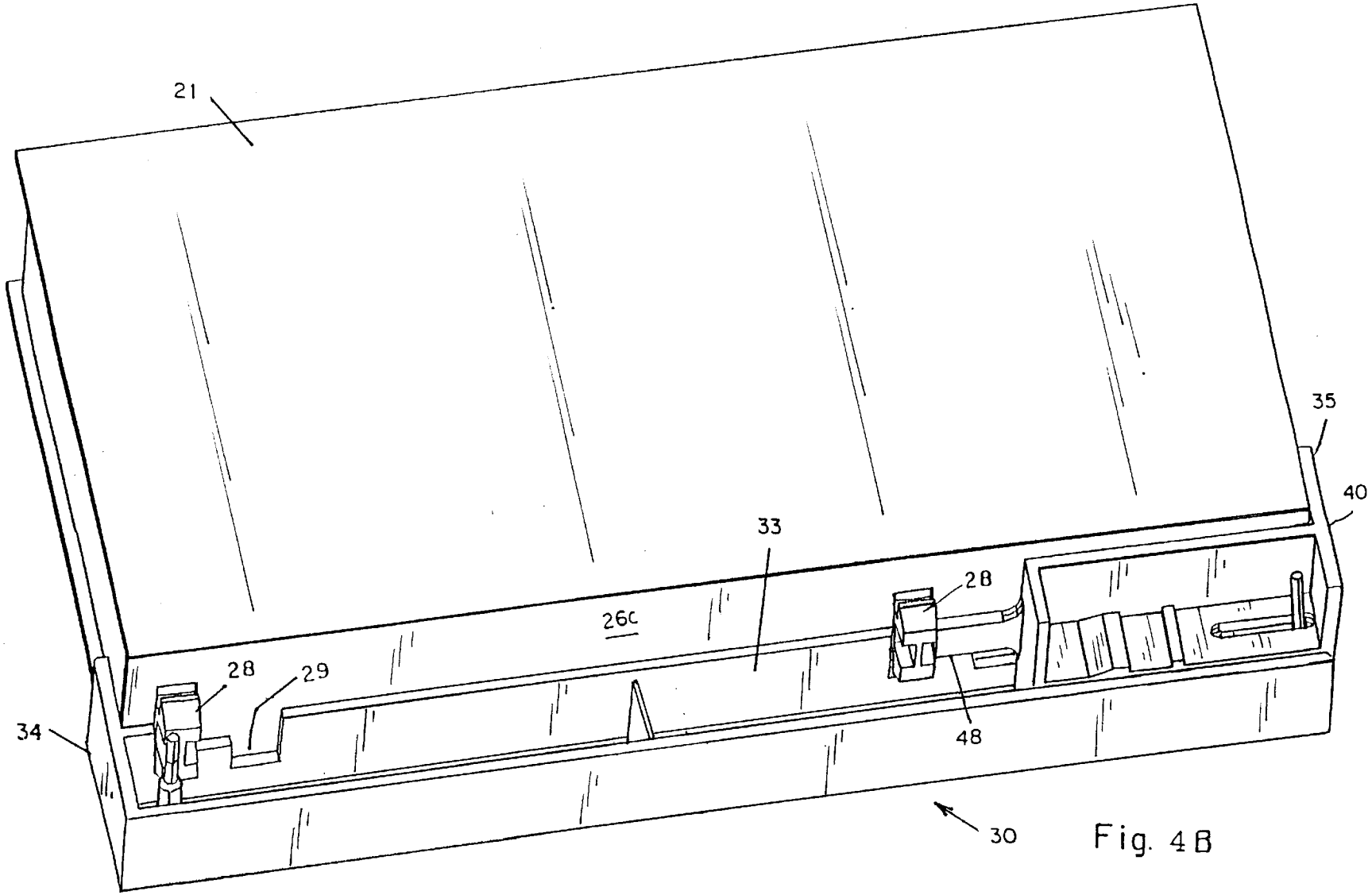
FIG. 4B is a partially broken away view of the locking mechanism fully engaged on the case.

Preferably, the case 21 includes molded tabs or hooks 28 projecting out of opposite ends of sidewall 26*c,* FIGS. 4A and 4B. The tabs 28 secure the case 21 to the lock 30 by interlocking with the slots 29, discussed below.

The case 21 may also include one or more tabs 27 that extend into the enclosure, perpendicular to the top 23*a* of the case 21, and underlying a videotape to help retain the tape in the case 21. The configuration of the tab 27 is more fully shown and described in U.S. Pat. No. 5,085,322.

Figure 10:
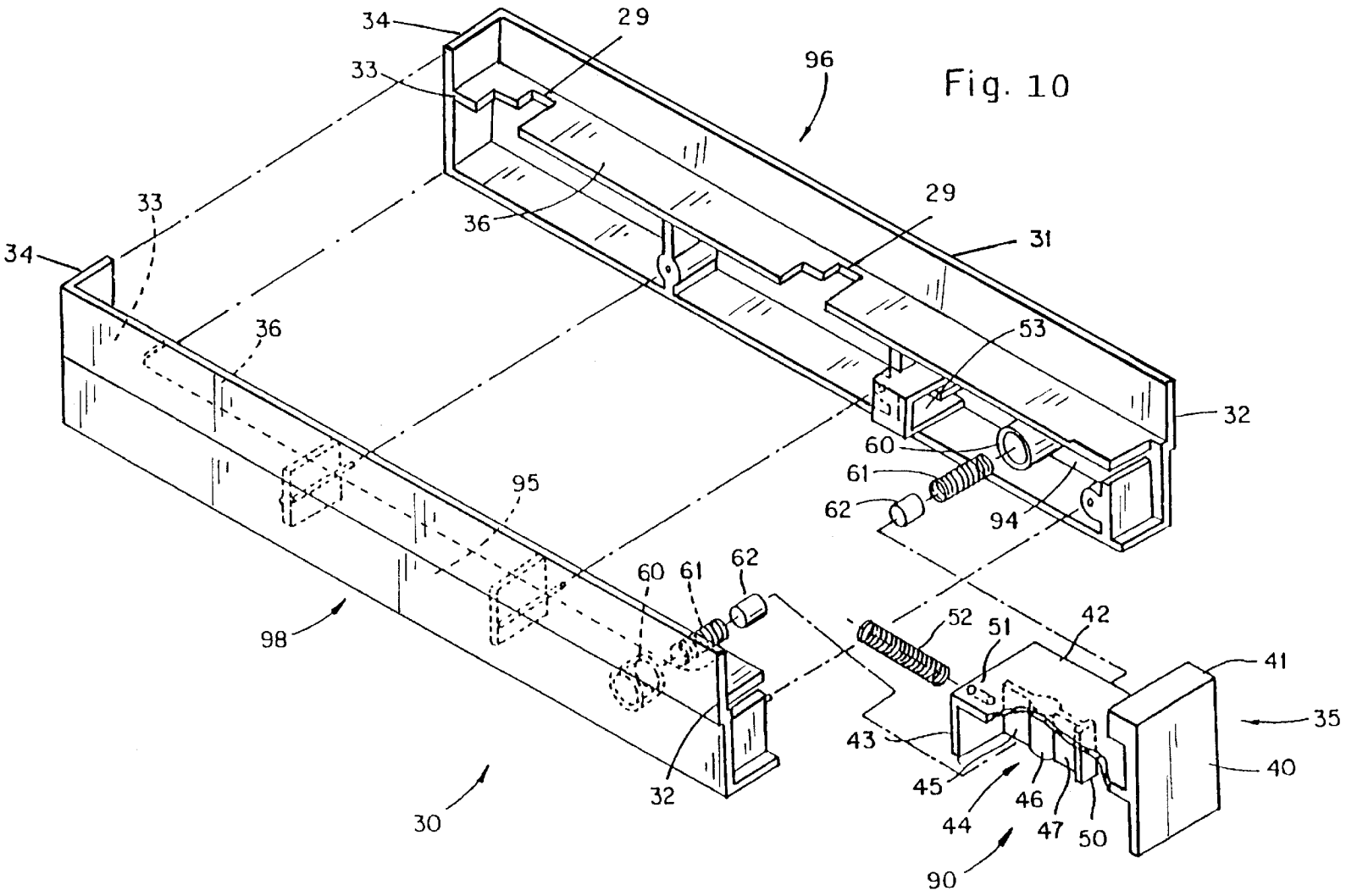
FIG. 10 is an exploded general perspective view of the locking mechanism and actuator.
Figure 11:
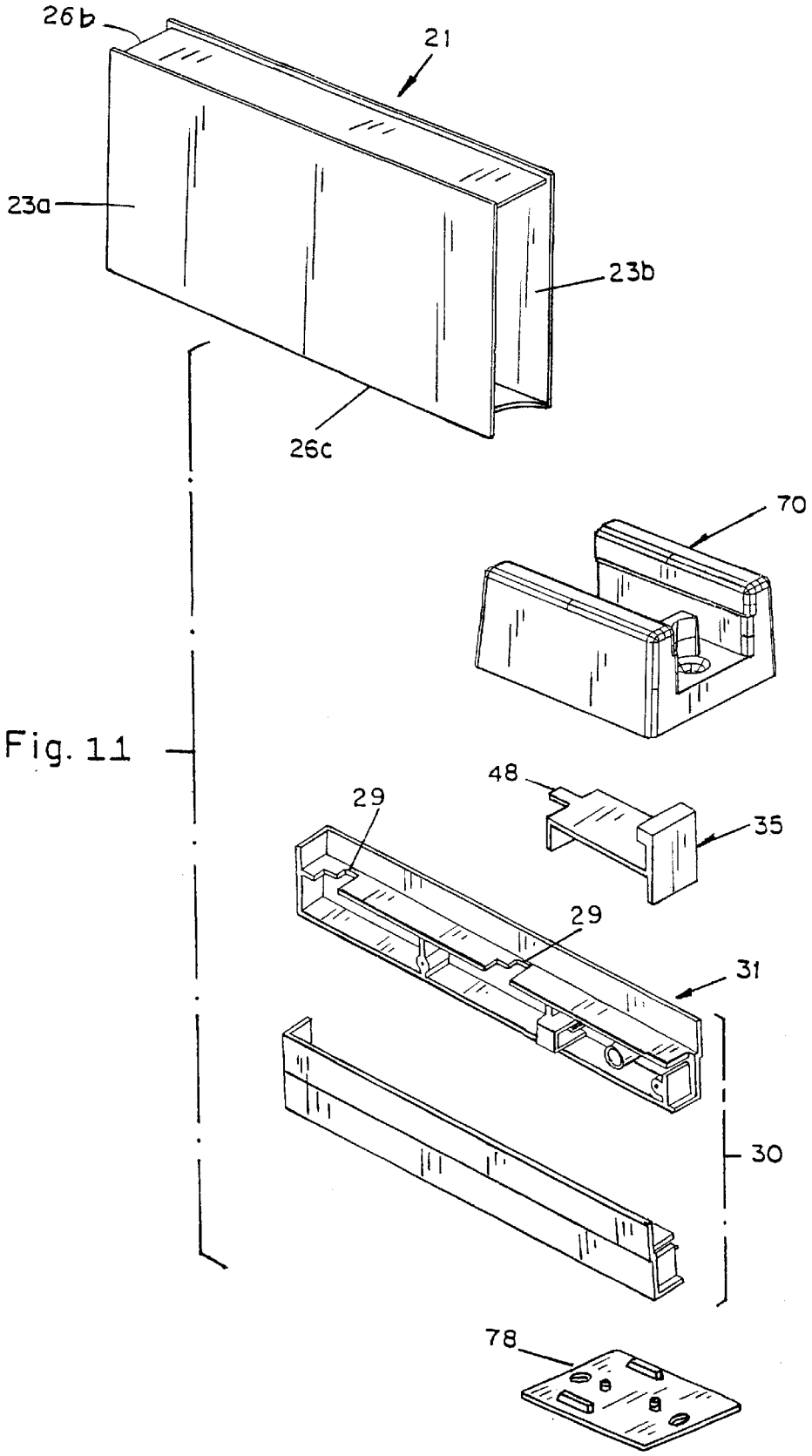
FIG. 11 is an exploded general perspective view of the case, the actuator, and the external outer halves of the locking mechanism.

The lock 30 is constructed as shown in FIGS. 10 and 11. The lock 30 includes a housing 31 and an actuator 90 at one end of the housing. The housing 31 is comprised of two portions 96 and 98 permanently connected to each other, for example by sonic welding. The portions 96 and 98 are substantially mirror images of each ocher, but portion 96 has a slot 53, to be described later, formed on an inner wall 94.

The two portions 96 and 98 include parallel flanges 32 extending from a cross-piece 33 of the housing 31. The flanges 32 are spaced apart from each other by a distance slightly greater than the maximum width of the case 21. These flanges overlie a portion of the top 23*a* and the bottom 23*b* of the case when the case is positioned on the cross-piece 33 of the housing 31. The two portions 96 and 98 also include portions 34 extending towards one another to form a backwall 34.

The actuator 90 includes a movable latch 35. The latch 35 buttresses up against the case 21 and/or the exposed end of a videotape that has been inserted into the open end 26*a* of the case 21, to be described later, to secure the videotape in the case 21.

Figure 5:
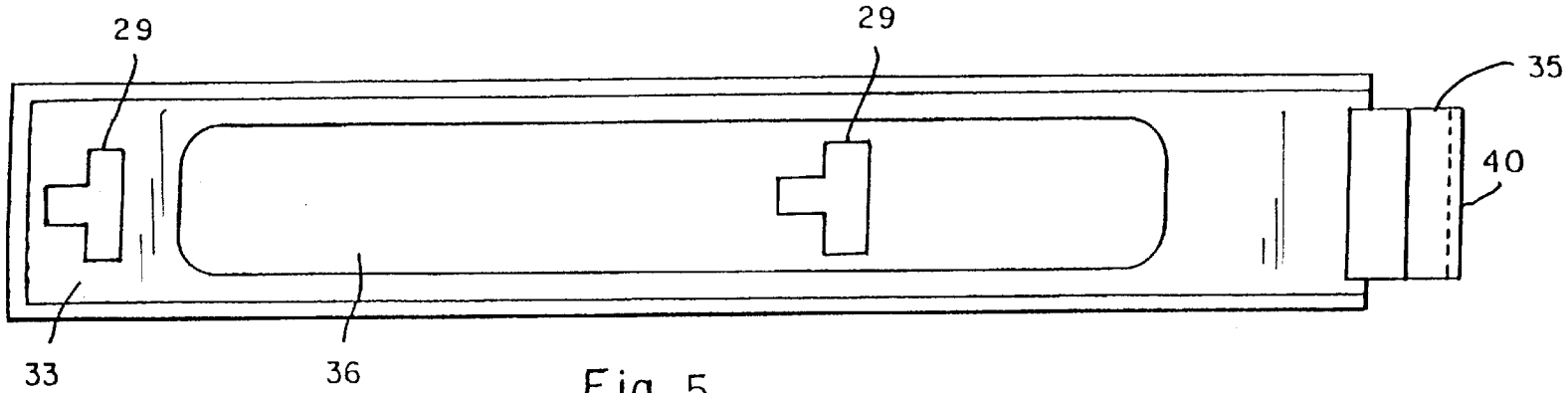
FIG. 5 is a top view of the locking mechanism.

Referring to FIG. 5, cross-piece 33 of the housing 31 has a recess 36 designed to provide a location for a security strip to be used with the lock. When a security strip is placed in the recess 36 and the lock 30 is fastened to the case 21, the security strip is inaccessible to the customer and remains with the merchandise until the lock is removed. Thus, if a customer attempts to exit the store concealing case 21 with lock 30 fastened, an external alarm (not shown) will sound.

Preferably, the slots 29 are formed in the cross-piece 33, and are arranged in a "T" formation when both halves 96 and 98 of the lock housing 31 are secured together, FIGS. 4A, 4B, and 11. The slots are constructed and arranged to first receive the tabs 28 in the slots' wider portion, FIG. 4A, and then to slidingly interlock with the slots' narrow portion, FIG. 4B, so that case 21 will be securely fastened to the lock 30 and can not be lifted out. Preferably, the slots are constructed and arranged so that the tabs 28 will need to slide approximately one-half inch (½") within the slots 29, before the tabs 28 are securely interlocked with the slots 29.

Referring now to FIGS. 4 and 11, the latch 35 includes an extension piece 48 that extends towards the backwall 34 of the lock housing 31. The extension piece 48 is adapted and arranged so that it abuts one of the tabs 28 when the lock 30 is in the locked or closed position, FIG. 4B. This prevents the tabs 28 from moving to the larger portion of the slots 29, and consequently prevents the case 21 from separating from the lock 30. Even if someone breaks off the external portion 40 of the moveable latch 35 and tries to remove the case 21, the case 21 would remain securely fastened to the lock 30 because the extension piece 48 would block movement of one of the tabs 28, and hence the case 21 remains secure within the lock 30.

The videotape would also not be able to be removed from the case 21 if the extension piece 40 were broken because of the tab portion 27 which functions to secure the videotape in the case 21. The tab portion 27 could not be defeated, i.e., moved out of the path of the videotape, because the top and bottom portions, 23*a* and 23*b* of the case 21, are secured between the parallel flanges 32 of the lock housing 31.

Referring now to FIGS. 1–4, to fasten the lock 30 to the case 21, and to secure a videotape inserted into the open end 26*a* of the case 21 as shown and described in U.S. Pat. No. 5,085,322, the case 21 including the inserted videotape is first placed on the cross-piece 33 of the lock housing 31. The case 21 is positioned so that the tabs 28 first interlock with the wider portion of the slots 29, FIG. 4A. The case 21 is then moved towards the backwall 34 of the lock housing 31, approximately one-half inch (½") until the tabs 21 are inserted into the narrow portion of the slots 29 and the sidewall 26*b* of the case 21 abuts the backwall 34, FIG. 4B.

Figure 6:
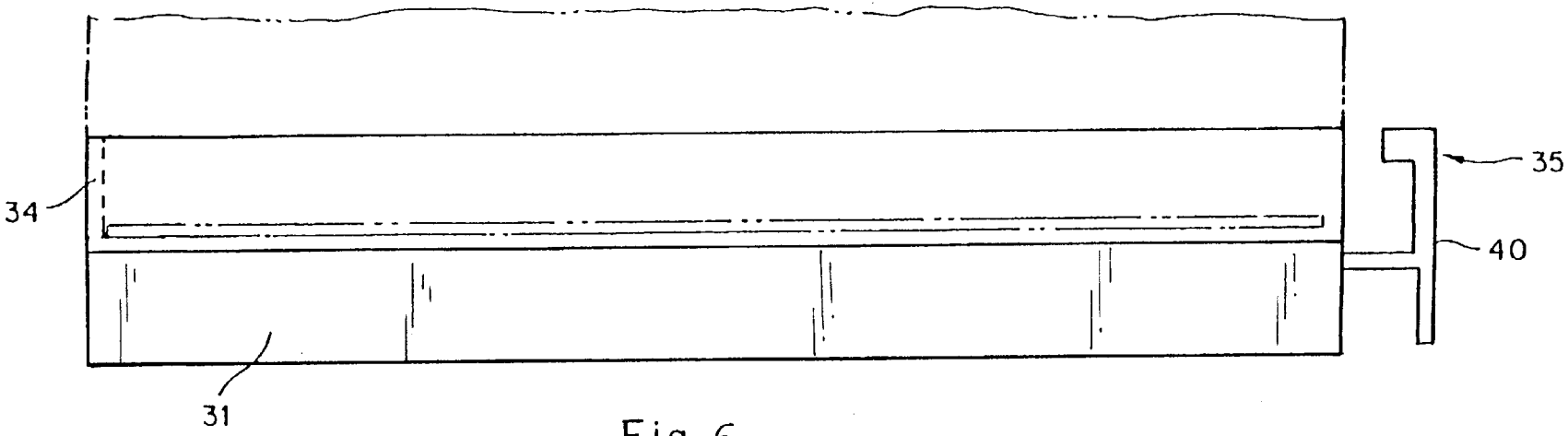
FIG. 6 is a side view of the locking mechanism unlocked from the case.

As shown in FIGS. 4B and 6, the actuator 90 is in the open position. In this position, the movable latch 35 is spaced away from, and does not abut, the case 21 nor the outer end of the videotape that rests in the open end 26*a* of the case 21 when the videotape is inserted in the open end 26*a*. To completely secure the case 21 to the lock 30, and to secure the videotape in the case 21, the actuator 90 is pressed so that the movable latch 35 abuts up against at least a portion of the case 21 and/or the outer end of the videotape that rests in the open end 26*a* of the case 21. The case 21 is now caught between backwall 34 and the latch 35, and the extension piece 48 abuts one of the tabs 28. This prevents removal of the case 21 from the lock 30 and the videotape from the case 21. If the sidewall 26*b* includes a door and hinge configuration as shown and described in U.S. Pat. No. 5,085,322, the backwall 34 would prevent removal of the videotape from that end of the case 21 as well.

When the actuator 90 reaches the closed position, i.e., the latch 35 abuts up against the a portion of the case 21 and the end of the videotape, a mechanism (to be described hereinafter) locks the actuator in position, helping to secure the lock 30 to the case 21.

Referring to FIG. 10, the actuator 90 and mechanism for locking the actuator in position is described. The actuator comprises the latch 35, which includes an external portion 40, a portion 42 extending inward from the external portion 40, and another portion 43 extending downward. The external portion 40 abuts the end of the videotape resting in the open end 26*a* of the case 21. Preferably, the external portion 40 is sufficiently flat so that it sits squarely on the end of the videotape, although it can be any shape just so long as it secures the videotape in the case 21.

The portions 42 and 43 of the actuator 90 move longitudinally between the ends of the lock 30 beneath the cross-piece 33 when the actuator is opened or closed. Another cross-piece 44 formed beneath the actuator portion 42 has one end attached to actuator portion 43 with the other end extending a prescribed distance towards the hook portion 40. A wall 50, parallel to the portions 40 and 43, is formed at the other end of the cross-piece 44.

A protrusion 51 extending from the actuator portion 43 towards the backwall 34 of housing 31, is adapted to receive a spring 52. The spring 52 fits over the protrusion 51 and has one end resting against the portion 43. The other end of the spring rests against a back surface of the slot 53 formed between the inner walls of the housing 31. The length of the portion 51 is designed so that the free end of the protrusion does not strike the back surface of the slot 53 when the actuator is in the closed position.

Sleeves 60 are formed on opposing sides of the inner walls 94 and 95 of the housing 31. Each sleeve, adapted to receive a spring 61 and steel pin 62, allows the steel pin under load from the spring to freely engage the cross-piece 44. The length of each steel pin is such that the pin does not extend beyond the outer edge of the sleeve when the spring 61 is fully compressed.

The shape of the cross-piece 44 between the wall 50 and the portion 43 is designed to facilitate latching of the actuator using the spring loaded steel pins 62. In particular, each side of the cross-piece 44 has, in succession, a flat segment 45, a curved segment 46, and another flat segment 47. The curvature of the segment 46 is greater at the junction to the flat segment 47 than at the junction to the flat segment 45. The wall 50, the flat segment 47, and the junction between the flat segment 47 and the curved segment 46 form a seat an each side of the cross piece 44 for the steel pins 62. When the actuator 90 is in the closed position, the steel pins 62 are retained in the seats by the force exerted by the springs 61.

Figure 7A:
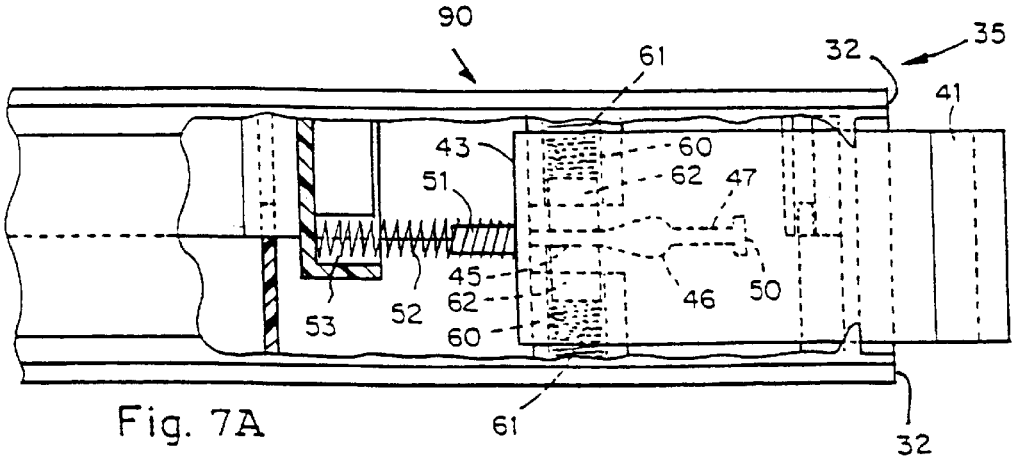
FIGS. 7A to 7C are sectional views of the bottom of the locking mechanism showing the actuator progressing from an open to a closed position.
Figure 7B:
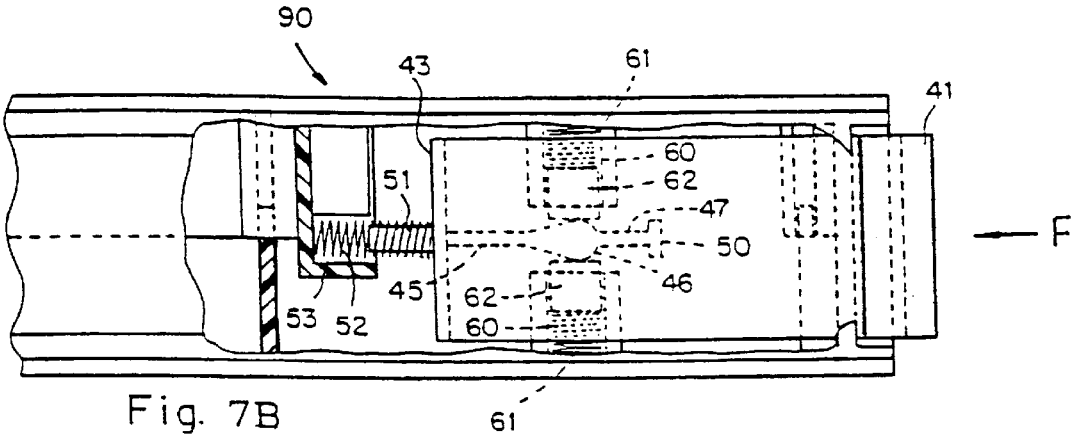
Figure 7C:
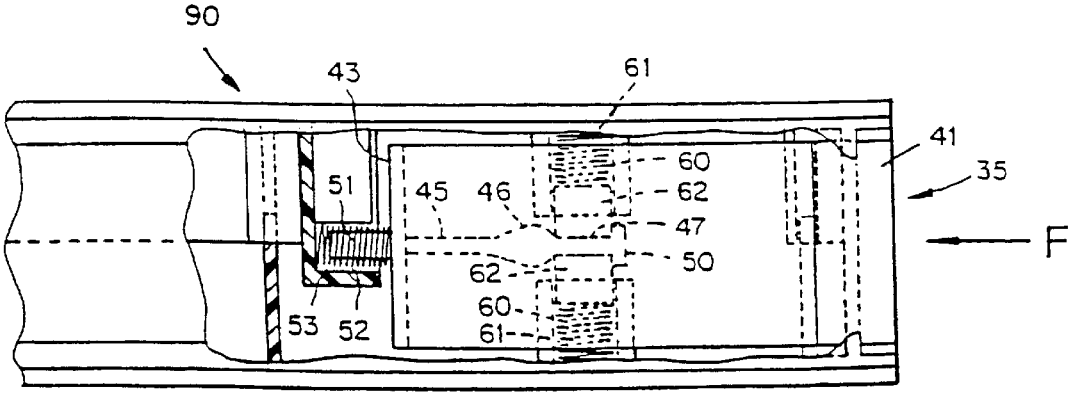

Description will now be made of the operation of the mechanism for latching the actuator closed with reference to FIGS. 7A–7C. As shown in FIG. 7A, when the actuator 90 is open, the movable latch 35 extends beyond the ends of the flanges 32, the spring 52 is almost fully decompressed and the springs 61 are less than fully compressed. The load of the springs 61 forces the steel pins 62 to rest against the flat segments 45. When a lateral force F is manually applied to the portion in the direction indicated, the movable latch 35 is forced towards the backwall 34, further compressing the spring 52. At the same time, the steel pins 62 move along the curved segments 46, further compressing the springs 61 as shown in FIG. 7B.

As the actuator 90 moves to the closed position, the spring 52 continues to compress, and at the same time, the springs 61 decompress slightly, rapidly forcing the steel pins 62 into the seats formed by the wall 50, the flat segment 47, and the junction between the flat segment 47 and the curved segment 46. The load exerted on the portion 43 by the compressed spring 52 causes an outer edge of each of the steel pins 62 to rest against the junction between the curved segment 46 and the flat segment 47. When the actuator 90 is closed, with the movable latch 35 engaging the case 21 (not shown) and the outer end of a videotape that has been inserted into the open end 26*a* of the case 21, and with the tabs 28 firmly secured in the slots 29, the lock 30 cannot be removed from the case 21 and the videotape cannot be removed from the case 21 as the force exerted on the steel pins 62 by the springs 61 lock the steel pins in their seats.

Referring now to FIGS. 2, 3, 8 and 9, once the actuator 90 is engaged in the closed position, it will only slide forward to the open position, i.e., be released, in the presence of a decoupler 70. This allows the case 21 to separate from the lock 30.

The decoupler 70 has a U-shaped housing which is positioned near a counter of a video store or any store that sells videotapes. Screws 81 (only one is shown) are used to fasten the decoupler to the counter, although other suitable means for fastening may be employed. The decoupler 70 has a base 71, outer surfaces 72, a flat surface 73, and inner surfaces 74 extending from the flat surface 73. The inner surfaces 74 each have a first portion 75 and a second portion 76 perpendicular to the surface 73. The distance between the first portions 75 is slightly greater than the width of the housing 31 of the lock 30, and the distance between the second portions 76 is slightly greater than the width of the flanges 32. This arrangement results in the formation of ledges 77. Because the flanges 32 of the lock 30 are wider than the base 73, the lower surfaces of the flanges 32 ride on the ledges 77 during a release operation.

Magnets 78 are positioned in the decoupler between each outer surface 72 and the first portion 75 of each inner surface 74. It should be realized that the magnets 78 should be sufficiently positioned within the decoupler 70 so that magnetic fields generated by the magnets 78 do not harm the media stored on the videotape contained in the case 21.

A vertical cross rib structure 80 is attached to the flat surface 73. Both the position of the magnets in the decoupler and the position of the vertical cross rib structure 80 on the flat surface 73 are arranged so that, during the release operation, the outer surface of the portion 40 of the actuator engages the vertical cross rib structure as the steel pins 62 align approximately with the center of the magnets 78.

Referring to FIGS, 2, 3, 4, 8 and 9, the release operation for the actuator using the decoupler 70 is described. The lock 30, fastened to the case 21, is brought in contact with the decoupler 70 by placing the housing 31 on the flat surface 73 with the outer surface of the portion 40 facing the vertical cross rib structure 80. As noted above, the lower surfaces of the flanges 32 will ride on ledges 77 during the release operation.

Figure 8:
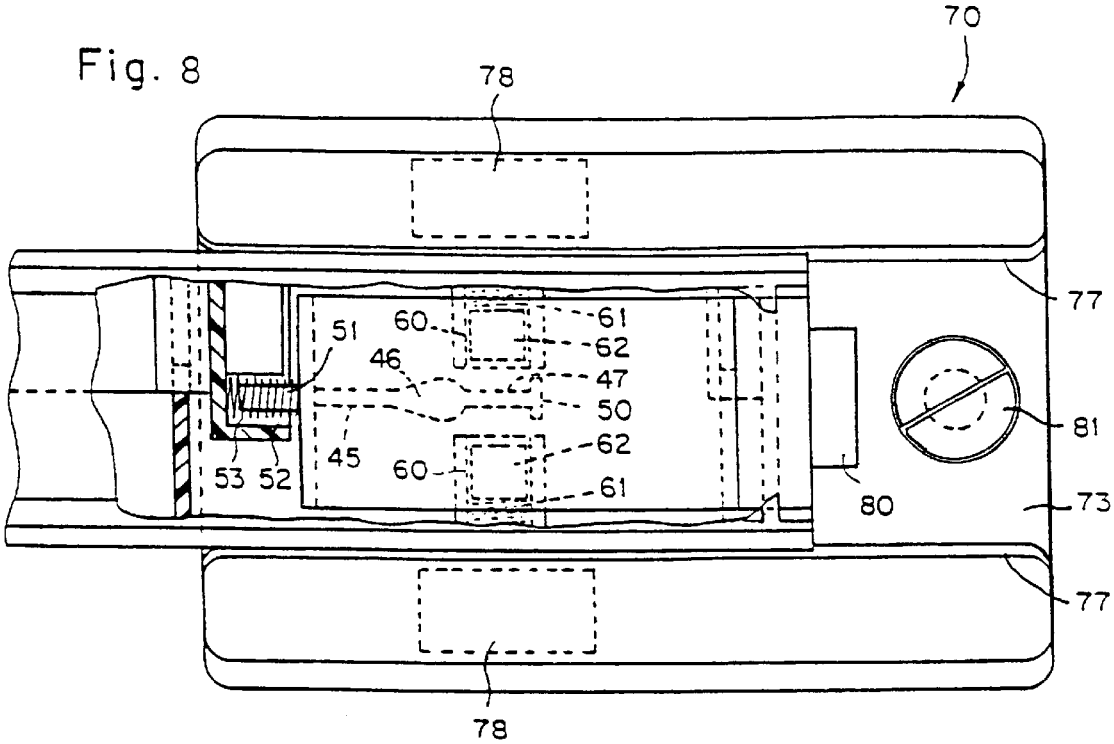
FIG. 8 is a cross-sectional top view of the security case of the present invention showing the actuator being unlocked by the decoupler.
Figure 9:
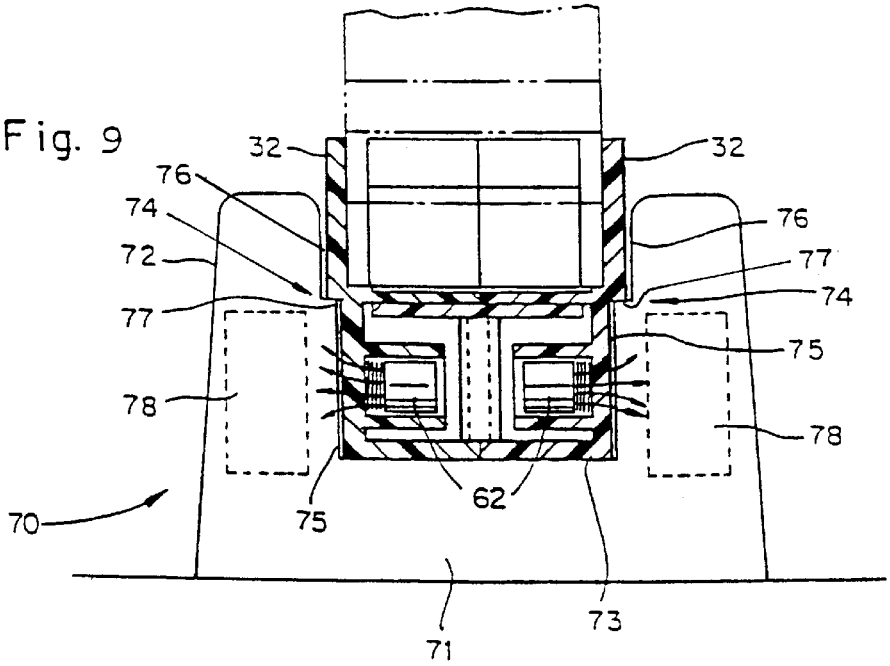
FIG. 9 is a cross-sectional end view of the security case showing the actuator being unlocked by the decoupler.

Next, the latched case is swiftly moved in a horizontal direction towards the vertical cross rib structure 80. This swift movement results in sharp contact between the outer surface of the portion 40 and the vertical cross rib structure 80. The sharp contact further compresses the spring 52, allowing the outer edges of the steel pins 62 to move away from the junction between the flat portion 47 and the curved portion 46 in each of the seats. This small movement is shown in FIGS. 7C and 8 as a slight shift in position of the steel pins 62. With the position of the steel pins 62 shifted, the force of each spring 61 on a corresponding steel pin is isolated, allowing the magnets 78 to draw the pins toward the sleeves, releasing the actuator 90. With the actuator 90 released, the force exerted by the spring 52 on the portion 43 moves the actuator 90 to an open position.

In the open position, the latch 35 no longer engages the case 21 and/or the outer end of the videotape stored in the case 21, and the extension piece 48 no longer abuts the tabs 28. The case 21 can be removed from the lock 30 by sliding the case 21 about one-half inch (½") until the tabs 28 engage the larger portion of the slots 29. The case 21 can now be simply lifted from the lock 30, or vice versa.

There accordingly has been described a security device for protecting displayed merchandise from theft using a case to receive the merchandise and a locking mechanism latching the case. The case and locking mechanism provide protection for videotapes stored in bottom-loaded cases and the like in a live merchandising format without increasing inventory space. The locking mechanism has a cross-piece with a recessed surface for a security strip and when the locking mechanism latches the case closed, the case is positioned on the cross-piece, making the security strip inaccessible to customers.

Although the present invention has been described in relation to particular embodiments thereof, many other variations and modifications and other uses will become apparent to those skilled in the art. It is preferred, therefore, that the present invention be limited not by the specific disclosure herein, and accordingly, all suitable modifications and equivalents may be resorted to, falling within the scope of the invention.

What is claimed is:

1. A security device comprising:

a case having a bottom access opening to receive merchandise, a top, two opposing ends and two opposing sidewall surfaces;

at least one tab protruding from the case; and a locking mechanism for maintaining the received merchandise in the case when the locking mechanism is closed, the locking mechanism being fully separable from the case when the locking mechanism is open and including a base housing including at least one slot to engage the tab to and secure the case to the locking mechanism, two substantially parallel flanges extending from the base housing and spaced apart from each other to overlie at least one of the sidewall surfaces of the case, an actuator on the base housing that partially extends adjacent to the access opening for maintaining the received merchandise in the case when the actuator is in a first position, the actuator slidably extending into the base housing, and a locking device in the base housing retaining the actuator in the first position when the locking mechanism is closed.

2. The security device of claim 1, further including a decoupler for opening the locking device.

3. The security device of claim 1, wherein the base housing includes a security strip.

4. A security device comprising:

a case having a bottom open end to receive merchandise, a top surface, two opposing ends and two opposing sidewall surfaces;

at least one tab protruding from the case; and a locking mechanism for maintaining the received merchandise in the case including a base housing including at least one slot to receive and retain the tab to secure the case to the locking mechanism, at least one flange extending from the base housing to overlie at least one of the sidewall surfaces of the case, a movable member for (i) maintaining the received merchandise in the case by blocking the bottom open end and securing the tab in the slot when the locking mechanism is closed and (ii) disengaging from the bottom open end when the locking mechanism is open allowing the tab to become fully separated from the slot and the locking mechanism to become fully separated from the case, and a steel pin biased from an inner surface of the base housing against a surface of the movable member for retaining the movable member from moving when the locking mechanism is closed.

5. The security device of claim 4, wherein the steel pin is biased against the surface of the movable member by a spring disposed between the steel pin and the inner surface of the base housing.

6. The security device of claim 4, further including a decoupler for releasing the retained movable member when the locking mechanism is closed.

7. The security device of claim 6, wherein the decoupler comprises:

a decoupler housing, and a magnet positioned in the decoupler housing, the magnet attracting the steel pin when the closed locking mechanism is positioned adjacent the magnet of the decoupler.

8. The security device of claim 7, wherein the locking mechanism includes two steel pins, each retained in a sleeve, the sleeves being attached to an inner surface of the base housing, the steel pins being biased against a surface of the moveable member for retaining the movable member when the locking mechanism is closed, and the decoupler includes at least one magnet positioned in the decoupler housing such that the steel pins are attracted to the at least one magnet and disengage the movable member when the locking mechanism is positioned adjacent the decoupler.

9. A locking mechanism for maintaining merchandise in a case, the case having a closed top end, an open bottom end, two opposing end walls and two opposing sidewalls, comprising:

a base housing for attachment to the case, the base housing having a main surface, the main surface of the base housing including at least one slot to engage at least one tab formed on the case to secure the case to the locking mechanism;

at least one flange extending from the main surface of the base housing for overlying a sidewall portion of the case;

an actuator which slidably extends into the base housing for maintaining merchandise received in the bottom open end of the case by (i) at least partially blocking the bottom open end of the case and securing the tab in the slot when the actuator is in a first closed position and (ii) disengaging from the bottom open end of the case when the actuator is in a second open position allowing the tab to become fully separated from the slot and the locking mechanism to become fully separated from the case.

10. The locking mechanism of claim 9, further including a decoupler for enabling the actuator to move from the closed position to the open position.

11. The locking mechanism of claim 9, further comprising two substantially parallel flanges extending from the main surface of the housing for overlying sidewall portions of the case;

the base housing including a fixed wall at one end for abutting the top of the case and having the actuator disposed at the other end of the base housing.

12. The locking mechanism of claim 11, wherein the base housing includes a locking device and the actuator includes at least one notch, the locking device operatively engaging the at least one notch to lock the actuator in the first closed position.

13. The locking mechanism of claim 12, wherein the locking device includes at least one steel pin biased from an inner surface of the base housing against the at least one notch of the actuator.

14. The locking mechanism of claim 13, wherein the locking device further includes at least one spring disposed between the inner surface of the base housing and the at least one steel pin such that the steel pin is biased against the notch.

15. The locking mechanism of claim 13, wherein the decoupler comprises:

a decoupler housing, and a magnet positioned in the decoupler housing, the magnet attracting the steel pin when the closed locking mechanism, is positioned adjacent the magnet of the decoupler.

16. The locking mechanism of claim 15 including two steel pins, each retained in a sleeve, the sleeves being attached to an inner surface of the housing, the steel pins being biased against a surface of the movable member, and the decoupler includes at least one magnet positioned in the decoupler housing such that the steel pins are attracted to the at least one magnet and disengage the movable member when the locking mechanism is positioned adjacent the decoupler.

17. The locking mechanism of claim 13, wherein the actuator includes at least one curved surface adjacent the at least one notch such that the at least one steel pin does not prohibit the actuator from moving from the second open position to the first closed position.

18. The locking mechanism of claim 9, wherein the housing includes a security strip.

19. The locking mechanism of claim 9, wherein the at least one slot includes a wide portion for receiving the at least one tab and a narrow portion for slidingly interlocking the tab.

20. The locking mechanism of claim 9, wherein the actuator includes an extension member for engaging the tab and preventing the tab from disengaging from the slot when the actuator is in the first closed position.

21. A security device for locking merchandise comprising:

a case having an open end for receiving the merchandise, a closed end, an outer surface and at least one tab protruding from the outer surface; and a locking mechanism for maintaining the received merchandise in the case, the locking mechanism being fully separable from the case and including a base housing having at least one slot, the slot being operatively engageable with the tab, at least one flange extending from the base housing to overlie at least a portion of the outer surface of the case, and a movable member which slidably extends into the base housing, the movable member being movable between a first closed position such that it prevents the tab from disengaging the slot and prevents the locking mechanism from separating from the case and a second open position such that the tab may be disengaged from the slot and the locking mechanism may be fully separated from the case.

22. The security device of claim 21, wherein the locking mechanism further includes a locking device in the base housing for fixing the movable member in the first position when the movable member is closed.

23. The security device of claim 21 wherein the base housing includes two substantially parallel flanges which extend from the base housing and overlie portions of the outer surface of the case.

24. The security device of claim 21, wherein the case includes an integral spring tab portion disposed at its open end, the spring tab being manually pivotable with respect to the outside surface of the case to release the merchandise from the open end of the case and the flange operatively engages the spring tab to prevent the spring tab from releasing the merchandise from the case.

25. The security device of claim 21, wherein:

the case includes an integral spring tab portion disposed at its open end, the spring tab being manually pivotable with respect to the outside surface of the case to release the merchandise from the open end of the case; and the base housing includes two substantially parallel flanges which extend from the base housing to overlie portions of the outer surface of the case, at least one flange operatively engaging the spring tab and preventing the spring tab from releasing the merchandise from the case.

26. The security device of claim 21 wherein the base housing has two opposite ends and includes a fixed member disposed at one end of the base housing, the movable member being disposed at the other end of the base housing.

27. The security device of claim 26, wherein the movable member is adjacent the open end of the case when the movable member is in the first closed position such that the movable member prevents the merchandise from being removed from the case.

28. The security device of claim 21, wherein the slot of the base housing includes a wide portion for receiving the tab and a narrow portion for slidingly interlocking the tab.

29. The security device of claim 28, wherein the base housing includes two slots, the case includes two corresponding tabs and the slots have a wide portion for receiving the tabs and a narrow portion for slidingly interlocking the tabs.

30. The security device of claim 29, wherein the movable member is adjacent one of the open and closed ends of the case when the movable member is in the first closed position such that the case is prevented from moving and the tabs are prevented from disengaging the slots.

31. The security device of claim 21, wherein the movable member includes a sliding portion which slidably extends into the base housing.

32. The security device of claim 31, wherein the sliding portion of the movable member includes an extension member which operatively engages the tab of the case when the movable member is in the first closed position such that the tab is prevented from disengaging the slot.

33. The security device of claim 31, wherein the locking mechanism further includes a locking device, the locking device fixing the movable member in the first closed position when the locking device is engaged and permitting movement of the movable member into the second open position when the locking device is disengaged.

34. The security device of claim 33, wherein the sliding portion of the movable member includes at least one notch, the notch being contacted by the locking device when the locking device is engaged such that the movable member is fixed in the first closed position.

35. The security device of claim 33, wherein the locking device includes at least one steel pin which is biased against the sliding portion of the movable member and fixes the movable member when the movable member is in the first closed position.

36. The security device of claim 33, wherein:

the sliding portion of the movable member includes at least one notch, the notch being contacted by the locking device when the locking device is engaged such that the movable member is fixed in the first closed position; and the locking device includes at least one steel pin which is normally biased against the sliding portion of the movable member and fixes the movable member in the first closed position when the steel pin engages the notch of the sliding portion.

37. The security device of claim 36, wherein the sliding portion includes at least one curved surface forming part of the notch such that the contact of the steel pin does not prohibit the movable member from moving from the second open position to the first closed position.

38. The security device of claim 36, wherein at least one spring is coupled to an inside surface of the base housing and biases the at least on steel pin against the sliding portion.

39. The security device of claim 21, wherein:

the locking mechanism further includes a locking device, the locking device fixing the movable member in the first closed position when the locking device is engaged and permitting movement of the movable member into the second open position when the locking device is disengaged; and the security device further comprises a decoupler for disengaging the locking device.

40. The security device of claim 39 wherein the decoupler includes a decoupler housing having at least one magnet disposed therein such that the locking device is disengaged when the decoupler housing is positioned adjacent the base housing.

41. The security device of claim 39, wherein:

the movable member includes a sliding portion which slidably extends into the base housing;

the locking device includes at least one steel pin which is biased against the sliding portion of the movable member and fixes the movable member when the movable member is in the first closed position, the steel pin being attracted to the magnet and disengaged from the sliding portion when the decoupler housing is positioned adjacent the base housing.

42. The security device of claim 39, wherein:

the movable member includes a sliding portion which slidably extends into the base housing;

the sliding portion of the movable member includes two oppositely spaced surfaces each having a notch disposed therein, the notches being contacted by the locking device when the locking device is engaged such that the movable member is fixed in the first closed position;

the locking device includes two oppositely disposed steel pins which are normally biased against the spaced surfaces of the sliding portion, the steel pins fixing the movable member in the first closed position when the steel pins engage the notches; and the decoupler including a decoupler housing, the decoupler housing including a channel having two oppositely spaced sides for receiving at least a portion of the base housing having the locking device disposed therein, the decoupler housing having a magnet disposed adjacent each side;

the magnets attracting the steel pins, moving them out of the notches of the sliding portion and allowing the movable member to move to the second open position when the base housing is positioned within the channel of the decoupler housing.

43. A security device for locking merchandise comprising:

a case having an open end for receiving the merchandise, a closed end, and an outer surface; and a locking mechanism for maintaining the received merchandise in the case, the locking mechanism being fully separable from the case and including a base housing coupled to the case, at least one flange extending from the base housing to overlie at least a portion of the outer surface of the case, and a movable member which slidably extends into the base housing, the movable member being movable between a first closed position where it maintains the received merchandise in the case by at least partially blocking the bottom open end and a second open position such that the locking mechanism may be fully separated from the case.

44. The security device of claim 43, wherein the locking mechanism further includes a locking device in the base housing for fixing the movable member in the first position when the movable member is closed.

45. The security device of claim 43 wherein the base housing includes two substantially parallel flanges which extend from the base housing and overlie portions of the outer surface of the case.

46. The security device of claim 43, wherein the case includes an integral spring tab portion disposed at its open end, the spring tab being manually pivotable with respect to the outside surface of the case to release the merchandise from the open end of the case and the flange operatively engages the spring tab to prevent the spring tab from releasing the merchandise from the case.

47. The security device of claim 43, wherein:

the case includes an integral spring tab portion disposed at its open end, the spring tab being manually pivotable with respect to the outside surface of the case to release the merchandise from the open end of the case; and the base housing includes two substantially parallel flanges which extend from the base housing to overlie portions of the outer surface of the case, at least one flange operatively engaging the spring tab and preventing the spring tab from releasing the merchandise from the case.

48. The security device of claim 43 wherein the base housing has two opposite ends and includes a fixed member disposed at one end of the base housing, the movable member being disposed at the other end of the base housing.

49. The security device of claim 48, wherein the movable member is adjacent the open end of the case when the movable member is in the first closed position such that the movable member prevents the merchandise from being removed from the case.

50. The security device of claim 43, wherein the locking mechanism further includes a locking device, the locking device fixing the movable member in the first closed position when the locking device is engaged and permitting movement of the movable member into the second open position when the locking device is disengaged.

51. The security device of claim 50, wherein the sliding portion of the movable member includes at least one notch, the notch being contacted by the locking device when the locking device is engaged such that the movable member is fixed in the first closed position.

52. The security device of claim 50, wherein the locking device includes at least one steel pin which is biased against the sliding portion of the movable member and fixes the movable member when the movable member is in the first closed position.

53. The security device of claim 52, wherein:

the sliding portion of the movable member includes at least one notch, the notch being contacted by the locking device when the locking device is engaged such that the movable member is fixed in the first closed position; and the locking device includes at least one steel pin which is normally biased against the sliding portion of the movable member and fixes the movable member in the first closed position when the steel pin engages the notch of the sliding portion.

54. The security device of claim 53, wherein the sliding portion includes at least one curved surface forming part of the notch such that the contact of the steel pin does not prohibit the movable member from moving from the second open position to the first closed position.

55. The security device of claim 53, wherein at least one spring is coupled to an inside surface of the base housing and biases the at least on steel pin against the sliding portion.

56. The security device of claim 43, wherein:

the locking mechanism further includes a locking device, the locking device fixing the movable member in the first closed position when the locking device is engaged and permitting movement of the movable member into the second open position when the locking device is disengaged; and the security device further comprises a decoupler for disengaging the locking device.

57. The security device of claim 56 wherein the decoupler includes a decoupler housing having at least one magnet disposed therein such that the locking device is disengaged when the decoupler housing is positioned adjacent the base housing.

58. The security device of claim 56, wherein:

the movable member includes a sliding portion which slidably extends into the base housing;

the locking device includes at least one steel pin which is biased against the sliding portion of the movable member and fixes the movable member when the movable member is in the first closed position, the steel pin being attracted to the magnet and disengaged from the sliding portion when the decoupler housing is positioned adjacent the base housing.

59. The security device of claim 56, wherein:

the movable member includes a sliding portion which slidably extends into the base housing;

the sliding portion of the movable member includes two oppositely spaced surfaces each having a notch disposed therein, the notches being contacted by the locking device when the locking device is engaged such that the movable member is fixed in the first closed position;

the locking device includes two oppositely disposed steel pins which are normally biased against the spaced surfaces of the sliding portion, the steel pins fixing the movable member in the first closed position when the steel pins engage the notches; and the decoupler including a decoupler housing, the decoupler housing including a channel having two oppositely spaced sides for receiving at least a portion of the base housing having the locking device disposed therein, the decoupler housing having a magnet disposed adjacent each side;

the magnets attracting the steel pins, moving them out of the notches of the sliding portion and allowing the movable member to move to the second open position when the base housing is positioned within the channel of the decoupler housing.

* * * * *